US006547379B2

(12) United States Patent
Chan et al.

(10) Patent No.: US 6,547,379 B2
(45) Date of Patent: Apr. 15, 2003

(54) INK-JET HEAD CARTRIDGE WITH BUBBLE CHAMBER

(75) Inventors: Hsun-Hsien Chan, Chu-Pei (TW); Chih-Ching Chen, Taipei (TW)

(73) Assignee: BenQ Corporation, Taoyuan (TW)

( * ) Notice: Subject to any disclaimer, the term of this patent is extended or adjusted under 35 U.S.C. 154(b) by 0 days.

(21) Appl. No.: 09/683,646

(22) Filed: Jan. 29, 2002

(65) Prior Publication Data

US 2002/0130934 A1 Sep. 19, 2002

(30) Foreign Application Priority Data

Mar. 16, 2001 (TW) ..... 090106278

(51) Int. Cl.[7] ..... B41J 2/19
(52) U.S. Cl. ..... 347/92
(58) Field of Search ..... 347/92, 85, 86, 347/87, 93

(56) References Cited

U.S. PATENT DOCUMENTS 5,659,345 A * 8/1997 Altendorf ..... 347/87
6,007,192 A * 12/1999 Ahn ..... 347/87
6,234,622 B1 * 5/2001 Liu et al. ..... 347/93

FOREIGN PATENT DOCUMENTS

| | | |
|---|---|---|
| EP | 0 320 165 A1 | 11/1988 |
| EP | 0 727 314 A2 | 8/1996 |
| EP | 0 953 447 A2 | 11/1999 |

* cited by examiner

*Primary Examiner*—Michael Nghiem
(74) *Attorney, Agent, or Firm*—Winston Hsu

(57) ABSTRACT

A head cartridge with a bubble chamber has an ink reservoir, a print head, and an ink channel. The ink reservoir stores ink. The print head has a plurality of heaters for generating bubbles, so that ink is jetted from the print head by the bubbles. The ink channel is installed below the ink reservoir for transmitting ink into the print head from the ink reservoir, and the ink channel has a bubble chamber for collecting residual bubbles to increase an efficiency of the fluid in flowing from the ink reservoir to the ink pipe.

7 Claims, 7 Drawing Sheets

INK-JET HEAD CARTRIDGE WITH BUBBLE CHAMBER

BACKGROUND OF INVENTION

1. Field of the Invention

The present invention relates to head cartridges, and more particularly, the present invention provides an ink-jet head cartridge with a bubble chamber for collecting residual bubbles.

2. Description of the Prior Art

Typically, an inkjet printing device comprises a head cartridge that can move forward and backward on a rail to eject ink on a document for printing. The head cartridge comprises a housing, an ink reservoir for storing ink, and a print head that is fluidly connected to the ink reservoir for ejecting ink. The print head further comprises a plurality of heaters for generating bubbles by heating ink. The bubbles generated by the heaters push ink into the print head and cause the ink to eject from the print head.

However, after the ink is ejected, some bubbles are left in the ink chamber of the print head. These residual bubbles may be caused by incomplete contraction of a bubble, air released from ink after a heating/vibrating process, a surface roughness of the ink chamber and ink passage, or air slipping into the print head from outside of the print head. These residual bubbles can float through the fluid passage into an ink pipe, finally being stopped by a filter and accumulating beneath the filter, which is located between the ink pipe and the ink reservoir. The accumulation of the residual bubbles stops the ink from entering the ink pipe, so that the ink in the reservoir can no longer move into the print head. Thus, printing is affected by the residual bubbles.

Please refer to FIG. 1. FIG. 1 is a perspective view of the head cartridge 10 according to the prior art. The head cartridge 10 is disclosed in U.S. Pat. No. 6,007,192, "Head cartridge assembly for ink-jet printer", by SamSung Electronics. The ink cartridge 10 comprises an ink reservoir 12 for storing ink, a heater 14 for heating the ink, a filter 16 for filtering the ink that flows from ink reservoir 12, and a nozzle 18 employed to eject ink through a nozzle hole 22. The heater 14 heats the ink to generate bubbles, and the bubbles cause ink to jet from the nozzle hole 22. After the ink is jetted from the nozzle hole 22, residual bubbles accumulate beneath the filter 16. Accumulation of the residual bubbles causes movement of the ink supplied by the ink reservoir 12 to be hindered, such that the printing function of the ink cartridge 10 is affected

SUMMARY OF INVENTION

It is therefore a primary objective of the claimed invention to provide a head cartridge with a bubble chamber for collecting redundant bubbles.

According to the claimed invention, the head cartridge comprises an ink reservoir, a print head, and an ink channel. The ink reservoir stores ink. The print head comprises a plurality of heaters for generating bubbles, and ink is jetted from the print head by the bubbles. The ink channel is installed below the ink reservoir for moving ink from the ink reservoir to the print head, and the ink channel comprises a bubble chamber for collecting residual bubbles. Residual bubbles float upward into the bubble chamber.

It is an advantage of the claimed invention that because the redundant bubbles are collected in the bubble chamber, the residual bubbles do not affect printing.

These and other objectives and advantages of the present invention will no doubt become obvious to those of ordinary skill in the art after reading the following detailed description of the preferred embodiment, which is illustrated in the various figures and drawings.

DETAILED DESCRIPTION

Figure 1:
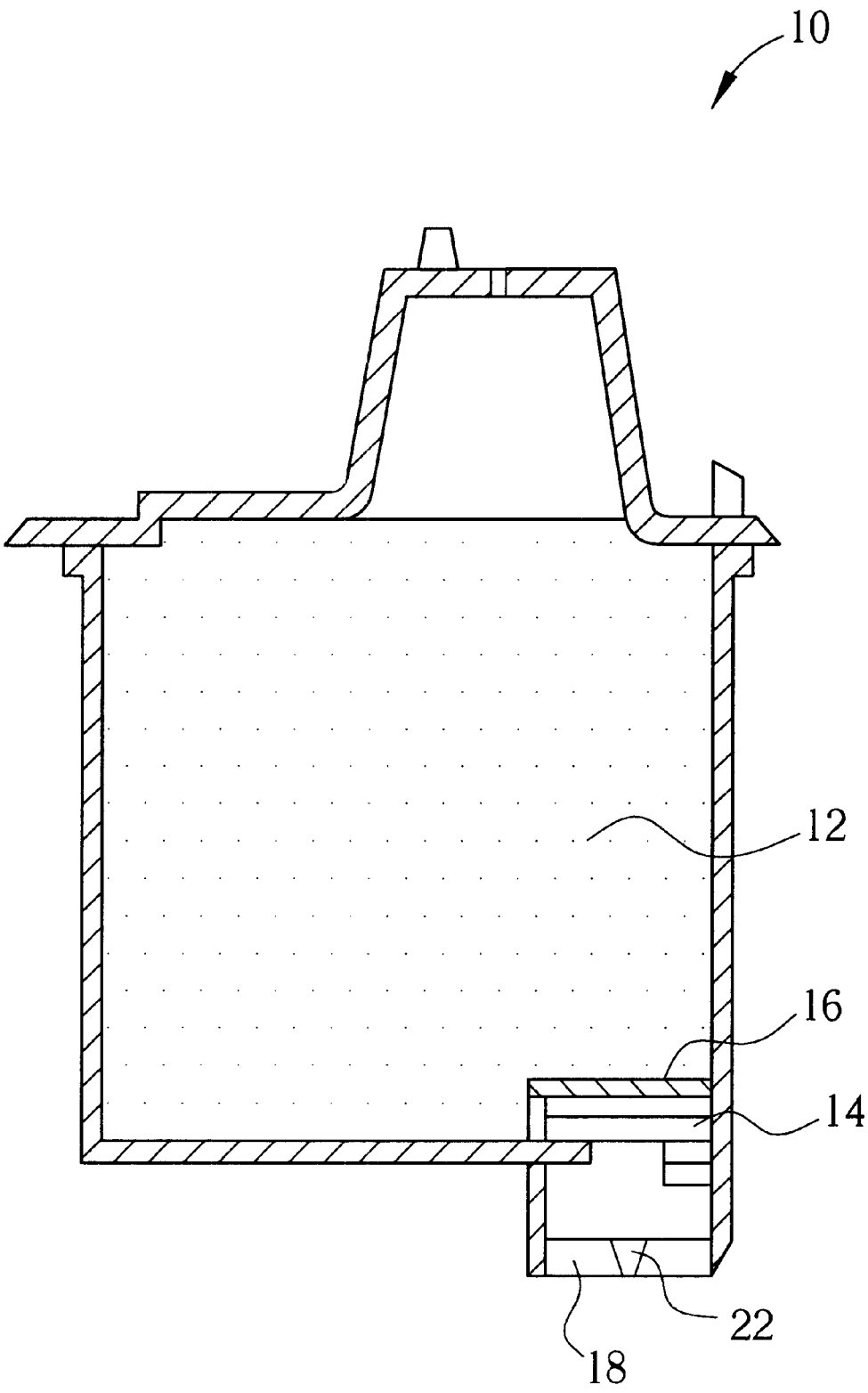
Fig. 1 Prior art
FIG. 1 is a perspective view of a head cartridge according to the prior art.
Figure 2:
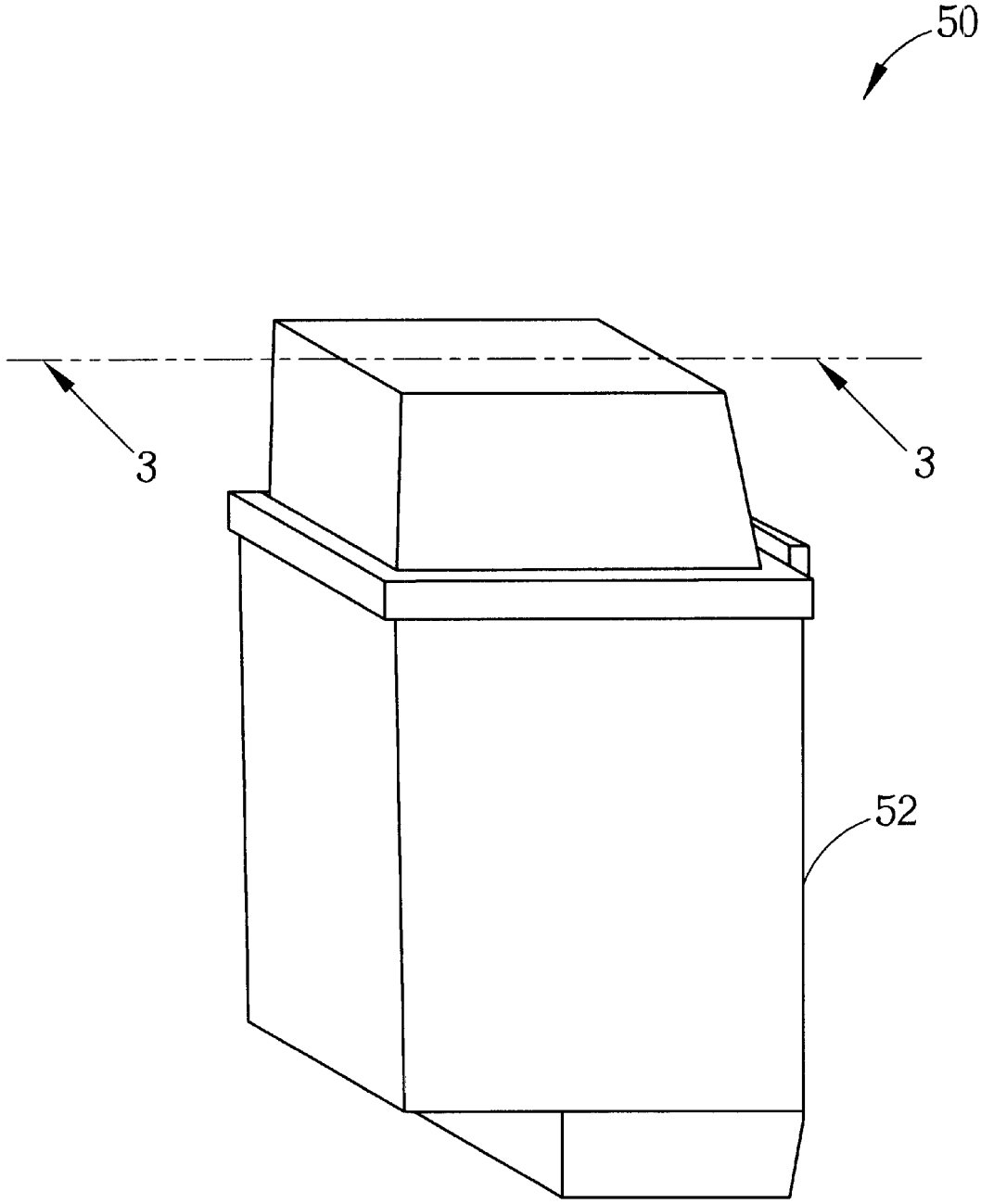
FIG. 2 is a perspective view of a first embodiment head cartridge according to the present invention.
Figure 3:
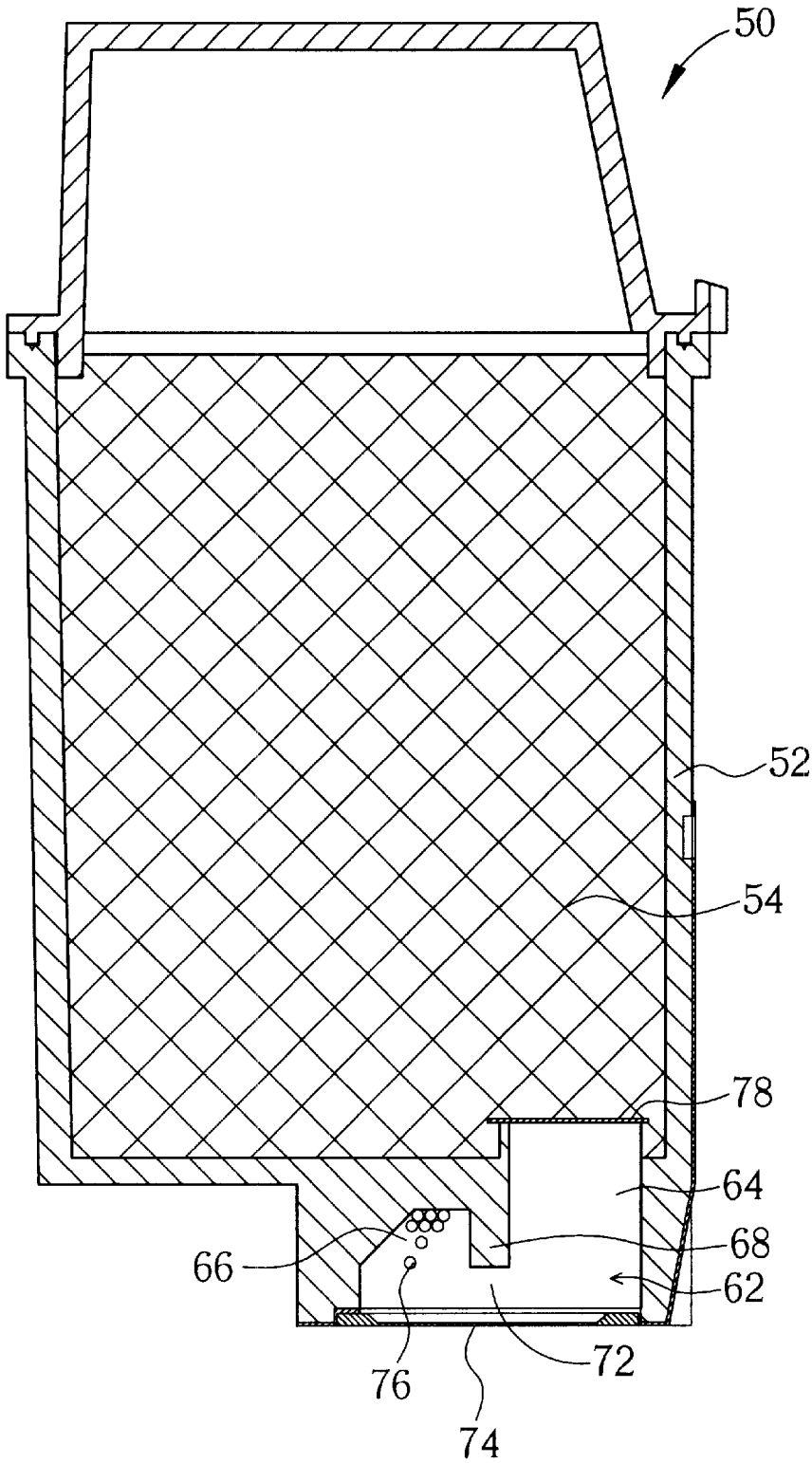
FIG. 3 is a sectional view along line 3—3 of the head cartridge shown in FIG. 2.
Figure 4:
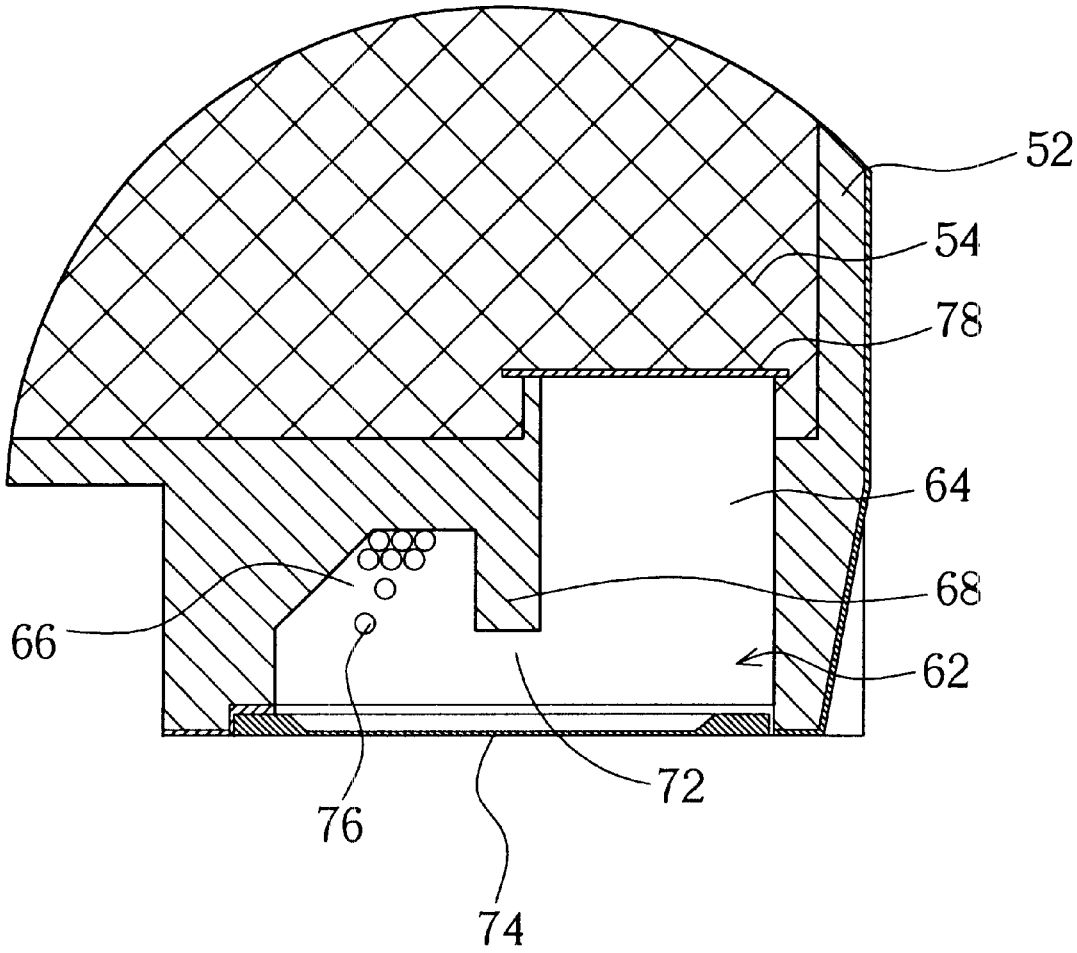
FIG. 4 is an enlarged view of a bubble chamber shown in FIG. 3.

Please refer to FIGS. 2–4. FIG. 2 is a perspective view of a first embodiment head cartridge 50 according to the present invention. FIG. 3 is a sectional view along line 3—3 of the head cartridge 50 shown in FIG. 2. FIG. 4 is an enlarged view of the bubble chamber shown in FIG. 3. The head cartridge 50 comprises an ink reservoir 52 for storing ink, and an ink channel 62 installed below the ink reservoir 52. The ink reservoir 52 has a protruded edge 68 for separating the ink channel 62, so as to form a bubble chamber 66 above the print head 74, an ink pipe 64 between the ink reservoir 52 and the bubble chamber 66, and an ink passage 72 between the print head 74 and the protruded edge 68 for connecting the ink pipe 64 and the bubble chamber 66.

The ink pipe 64 receives ink from the ink reservoir 52. The bubble chamber 66 collects bubbles 76. A suggested volume of the bubble chamber 66 is greater than 0.2 $cm^3$. The ink passage 72 conducts the ink to the bubble chamber 66 from the ink pipe 64. Furthermore, the ink reservoir 52 is fully filled with a porous material 54, such as a foam, for absorbing ink, so as to prevent ink from flowing into the ink pipe 64 when the printer is not printing. A filter 78 is installed on the top of the ink pipe 64 for the purpose of filtering ink.

The ink head cartridge 50 further comprises a print head 74. The print head comprises a plurality of heaters (not shown) and a plurality of nozzle holes (not shown). The heaters are employed to generate bubbles by heating ink. The bubbles cause the ink in the print head 74 to jet from the nozzle holes. If a bubble contracts incompletely, part of the bubble floats upward to enter the bubble chamber 66 and part of the bubble floats upward to enter the ink pipe 64.

Because part of the print head 74 is covered by the bubble chamber 66, the residual bubbles are collected in the bubble chamber and do not accumulate beneath the filter 78, which would hamper ink flowing into the ink pipe 64 from the ink reservoir 52. So, the residual bubbles do not affect printing.

Figure 5:
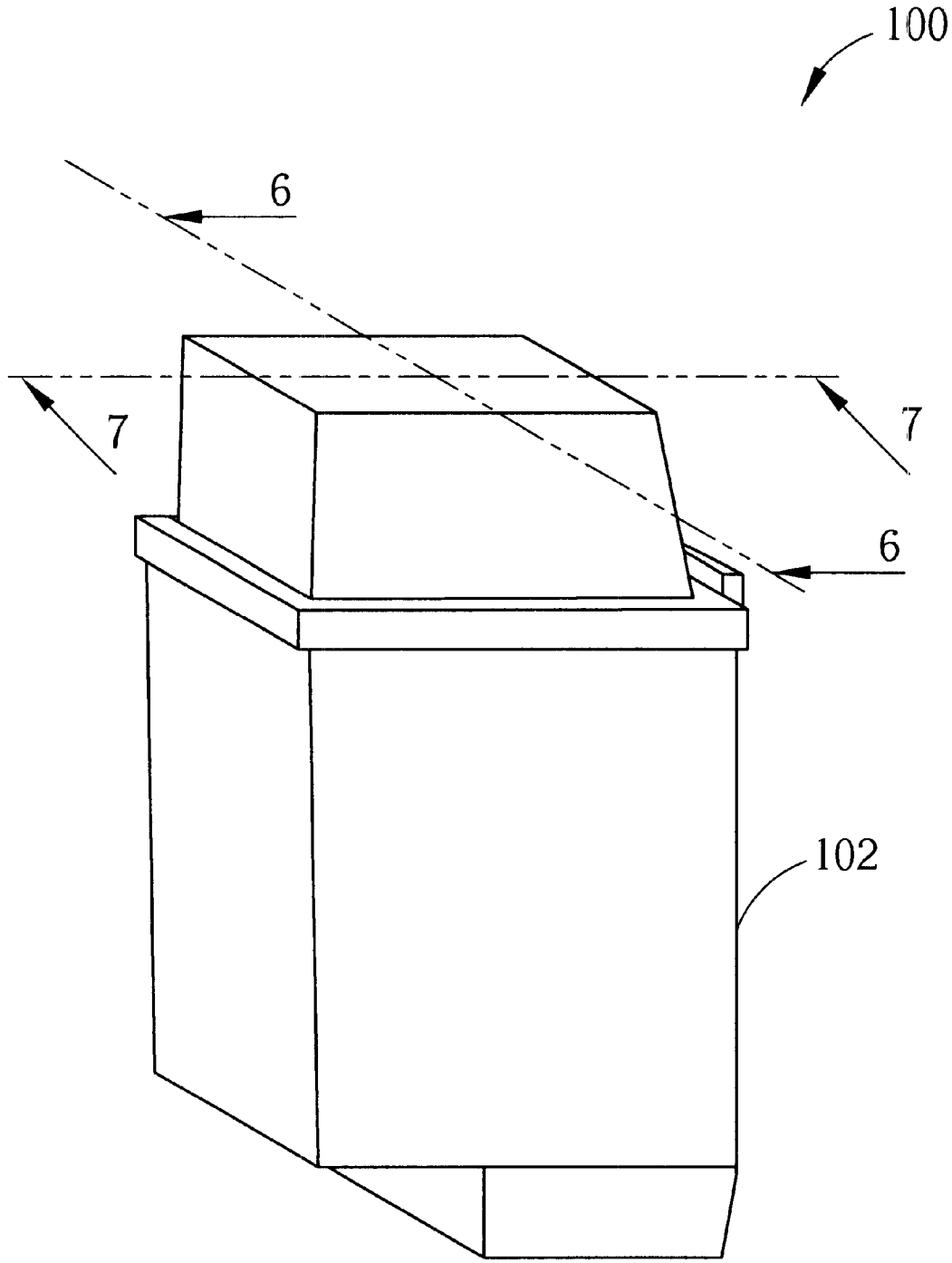
FIG. 5 is a perspective view of a second embodiment head cartridge according to the present invention.
Figure 6:
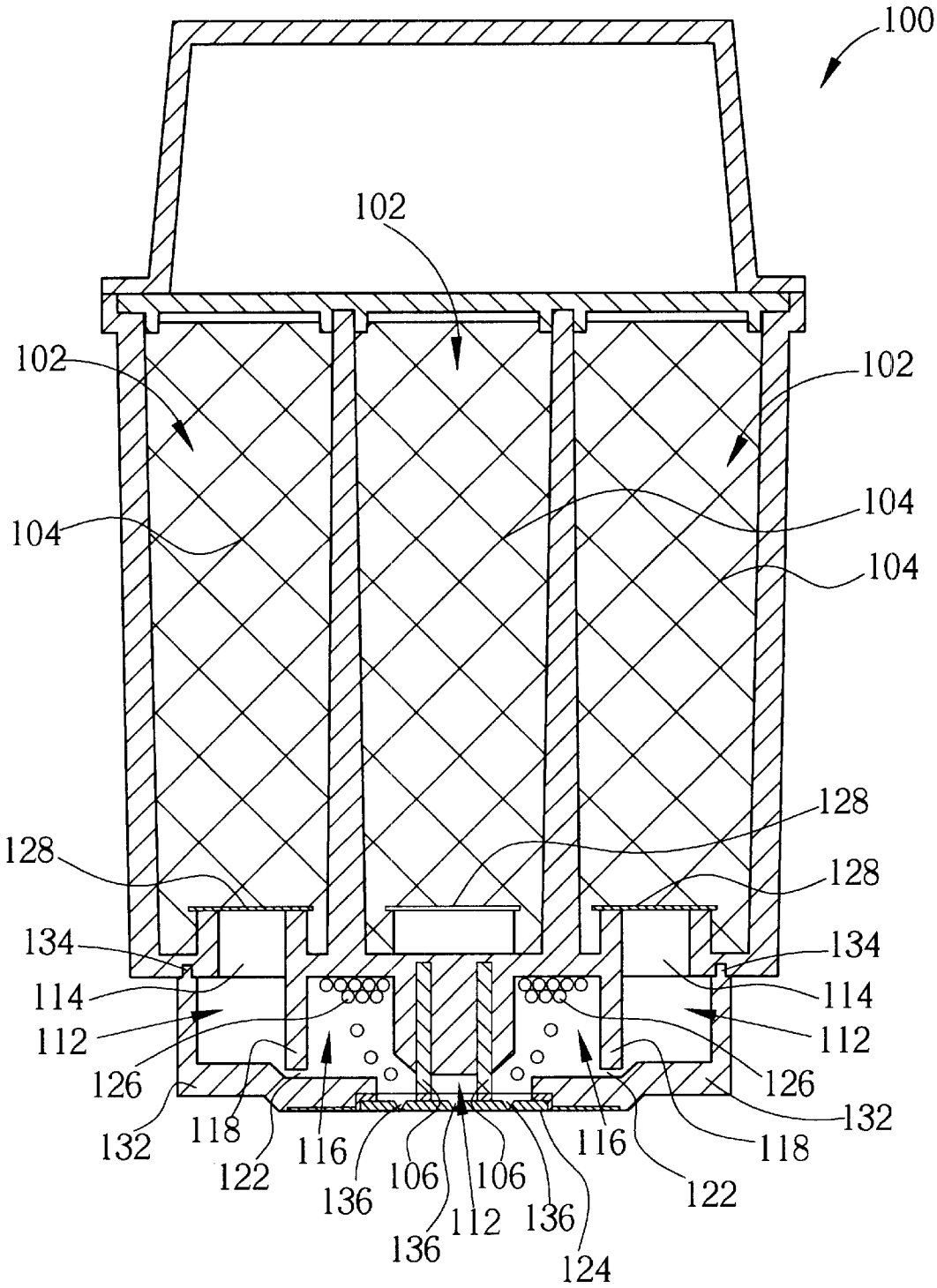
FIG. 6 is a sectional view along line 6—6 of the head cartridge shown in FIG. 5.
Figure 7:
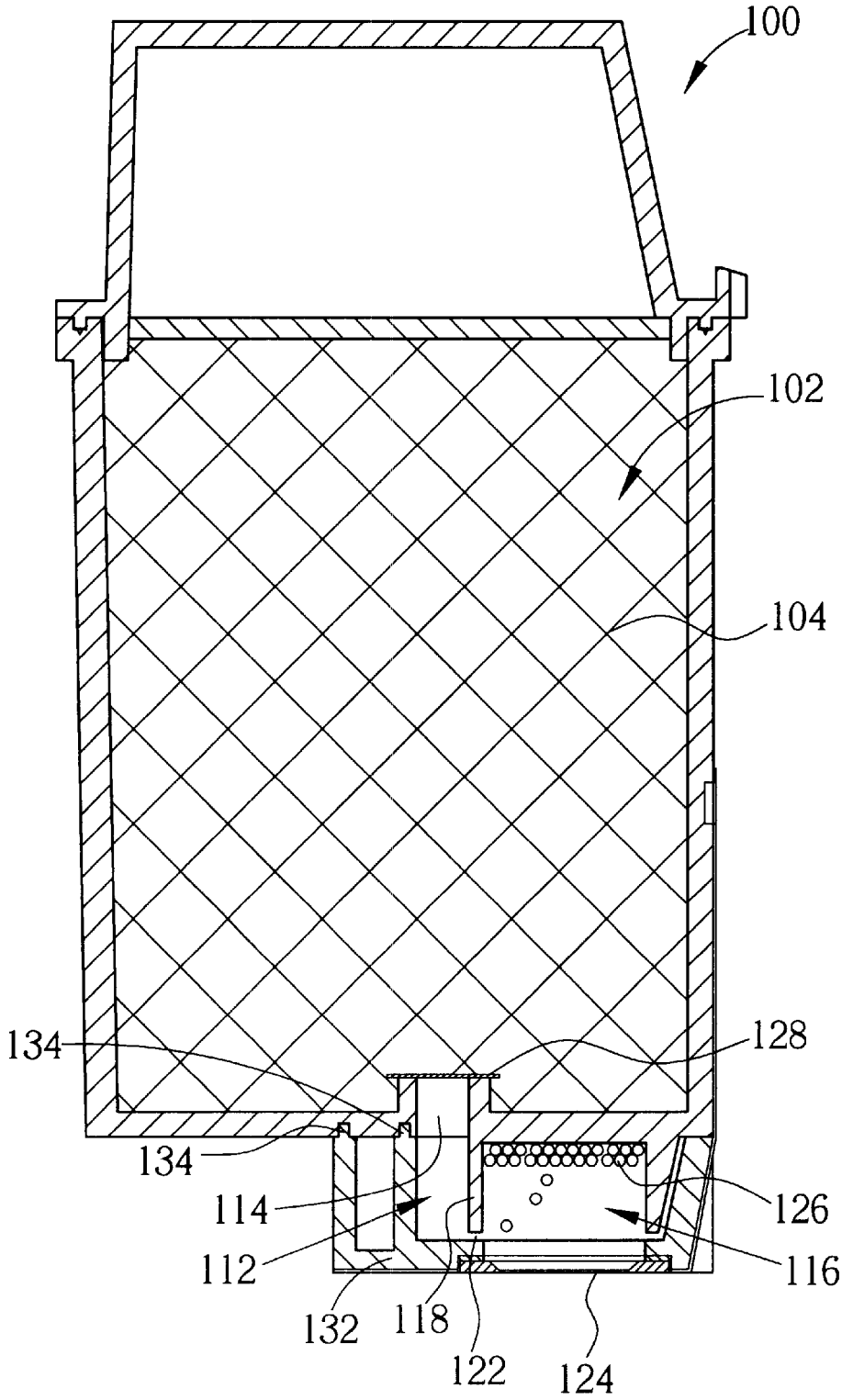
FIG. 7 is a sectional view along line 7—7 of the head cartridge shown in FIG. 5.

Please refer to FIGS. 5–7. FIG. 5 is a perspective view of a second embodiment head cartridge according to the present invention. FIG. 6 is a sectional view along line 6—6 of the head cartridge shown in FIG. 5. FIG. 7 is a sectional view along line 7—7 of the head cartridge shown in FIG. 5. The head cartridge 100 comprises three ink reservoirs 102 for storing yellow, magenta, and cyan colored inks.

Please refer to FIGS. 6–7. The head cartridge 100 further comprises one base plate 132 that is joined to the bottom of the ink reservoir 102. Joining together with the base plate 132, a bottom end of the ink reservoirs 102, and two separating walls 106, three independent ink channels 112 are formed below the ink reservoirs 102. Each ink channel 112 conducts one kind of ink to a print head 124 from a corresponding ink reservoir 102. At one end of each ink channel 112, a filter 128 is installed on the top of the ink pipe 114 for filtering the ink that flows from the ink reservoir 102. At the other end of the ink channel 112, an ink outlet 136 is installed for passing ink to the print head 124.

More particularly, the base plate 132 comprises at least one joint portion 134, so that the base plate 132 can be joined to the bottom of the corresponding ink reservoir 102 by using an ultrasonic wave melting process.

In each ink channel 112, an extruded edge 118 extends from the bottom of the corresponding ink reservoir 102, so as to separate a bubble chamber 116 from the ink channel 112. Also, an ink pipe 114 is formed between the bubble chamber 116 and the ink reservoir 102, and an ink passage 122 is formed between the extruded edge 118 and the base plate 132, as shown in FIG. 6 and FIG. 7.

To summarize the function of the fluid passage, ink flows from the ink reservoir 102, through the filter 128, to enter the ink pipe 114 and the ink channel 112, then flows through the ink passage 122 to enter the bubble chamber 116. Ink then arrives at the outlet 136, so as to be passed to the print head 124.

Each ink reservoir 102 is fully filled with a porous material 104, such as a foam, for absorbing ink stored in the ink reservoir 102, so as to prevent ink from flowing into the ink pipe 114 when the printer is not printing.

The ink head cartridge 100 comprises a print head 124. The print head 124 further comprises a plurality of heaters (not shown) and a plurality of nozzle holes (not shown). The heaters are employed to generate bubbles by heating ink, and these bubbles cause the ink in the print head 124 to jet from the nozzle holes. If the bubble contracts incompletely, part of the bubble floats upward to enter the bubble chamber 116. Because part of the print head 114 is covered by the bubble chamber 116, the residual bubbles are collected in the bubble chamber and do not accumulate beneath the filter 128 to hamper the ink entering the ink pipe 114 from the ink reservoir 102. So, the residual bubbles do not affect the printing function when the printer is printing.

In contrast to the prior art, the present head cartridge comprises a bubble chamber for collecting residual bubbles, so that the residual bubbles do not accumulate beneath the filter and hamper ink entering the ink pipe from the ink reservoir. Thus, the residual bubbles do not affect the printing function when the printer is printing.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A head cartridge comprising:

three ink reservoirs for storing ink, each of the link reservoirs having a bottom end, and each ink reservoir being used for storing ink of a different color;

three ink channels, one ink channel corresponding to each ink reservoir;

at least two protruded edges disposed in the bottom end of the ink reservoirs for separating a bubble chamber from each of the three ink channels;

a base plate having at least one joint portion to join with each of the ink reservoirs, the base plate further comprising two separating walls connecting with the bottom ends of the three ink reservoirs to form the three ink channels;

a print head disposed in the base plate, the print head capable of heating ink so as to generate bubbles, the bubbles causing ink to eject from the print head; and three outlets, one outlet formed on the bottom end of each ink reservoir, wherein the bass plate, the bottom end of the ink reservoirs, and the protruded edges form the three ink channels and the three corresponding bubble chambers, the ink channels are connected with the corresponding ink reservoirs and the corresponding outlets for transmitting ink from the connected ink reservoirs to the connected outlets, so that the outlets are capable of exporting ink to the print head for transmitting ink from the ink reservoirs to the print head, and the bubbles generated by the print head will float upwards so that the bubbles will be stored in the bubble chambers.

2. The head cartridge of claim 1 further comprising an ink pipe installed between an ink reservoir and an ink channel for receiving ink transmitted from an ink reservoir.

3. The head cartridge of claim 2 further comprising a filter installed above the ink pipe for filtering ink transmitted from the ink reservoir to the ink pipe.

4. The head cartridge of claim 1 wherein an ink channel comprises an ink passage formed between a protruded edge and the base plate.

5. The head cartridge of claim 1 wherein a bubble chamber has a capacity greater than 0.2 $cm^3$.

6. A method of manufacturing a head cartridge, the method comprising;

providing three ink reservoirs for storing ink of three different colors, the ink reservoirs having bottom ends connected to at least two protruded edges;

providing a base plate with a print head, the base plate having at least one joint portion to join with each of the reservoirs; and joining the ink reservoirs and the base plate together with two separating walls in order to form three ink channels the base plate, the bottom end of the reservoirs, and the protruded edges forming three corresponding ink channels and three corresponding bubble chambers, the protruded edges separating each ink channel from the corresponding bubble chamber, wherein the ink channels are connected with the corresponding ink reservoirs and the print head for transmitting ink from the ink reservoirs to the print head.

7. A method of claim 6 wherein, an ink reservoir and the base plate are melted together using ultrasonic waves.

* * * * *